United States Patent [19]

Matsuo et al.

[11] Patent Number: 4,915,030

[45] Date of Patent: Apr. 10, 1990

[54] APPARATUS FOR CONVEYING ARTICLES

[75] Inventors: Yukito Matsuo; Tsuyoshi Ishida; Hiromi Miyaji, all of Yokohama; Masanori Iwamoto, Tokyo, all of Japan

[73] Assignee: Kabushiki Kaisha Toshiba, Kanagawa, Japan

[21] Appl. No.: 90,006

[22] Filed: Aug. 27, 1987

[30] Foreign Application Priority Data

Sep. 5, 1986 [JP] Japan ..... 61-207756

[51] Int. Cl.[4] ..... B61B 7/00

[52] U.S. Cl. ..... 104/88; 104/117.1

[58] Field of Search ..... 104/88, 138.1, 1 B, 104/112, 137, 295, 178, 307, 117.1

[56] References Cited

U.S. PATENT DOCUMENTS

| | | | |
|---|---|---|---|
| 2,440,120 | 4/1948 | Ringler | 93/53 |
| 3,122,231 | 2/1964 | Pence et al. | 198/78 |
| 3,179,269 | 4/1965 | Arnett | 214/304 |
| 3,212,623 | 10/1965 | Griffith | 198/38 |
| 3,397,509 | 8/1968 | Ullman | 53/285 |
| 3,610,159 | 10/1971 | Fickenscher . | |
| 3,616,762 | 10/1971 | Benner . | |
| 3,675,585 | 7/1972 | Wiart et al. . | |
| 3,696,752 | 10/1972 | Bourg . | |
| 3,803,556 | 4/1974 | Duffy | 340/172.5 |
| 3,834,316 | 9/1974 | Hennings . | |
| 3,904,942 | 9/1975 | Holtz . | |
| 3,912,991 | 10/1975 | Moyse . | |
| 4,191,005 | 3/1980 | Vinoskey | 53/382 |
| 4,265,178 | 5/1981 | Veith | 104/88 |
| 4,519,491 | 5/1985 | Prodel et al. | 198/349 |
| 4,613,805 | 9/1986 | Matsuo et al. . | |
| 4,615,273 | 10/1986 | Osthus et al. | 104/102 |
| 4,658,947 | 4/1987 | Welder | 198/346.2 |
| 4,665,349 | 5/1987 | Matsuo . | |

FOREIGN PATENT DOCUMENTS

| | | |
|---|---|---|
| 0093863 | 11/1983 | European Pat. Off. . |
| 2536433 | 2/1977 | Fed. Rep. of Germany . |
| 2557767 | 6/1977 | Fed. Rep. of Germany . |
| 59-48306 | 3/1984 | Japan . |
| 59-102703 | 6/1984 | Japan . |
| 60-87108 | 5/1985 | Japan . |
| 2110448 | 6/1983 | United Kingdom . |
| 2121366 | 12/1983 | United Kingdom . |
| 2124989 | 2/1984 | United Kingdom . |
| 2168938 | 7/1986 | United Kingdom . |

*Primary Examiner*—Henry A. Bennet

*Attorney, Agent, or Firm*—Banner, Birch, McKie & Beckett

[57] ABSTRACT

An apparatus for conveying articles in carrier cases between one location in a hospital to a second location is disclosed. A station with a control panel is located in each room in the hospital which is to be reached by the system. A main conveyance path including a linear induction motor extends between each station. The stations include a branch conveyance path extending from a stop position on the main conveyance path to an input/output section for inputting carrier cases into the system or receiving carrier cases sent from other locations. A transferring device is located at each stop position and transfers carrier cases from the main conveyance path to each station. The system is run by a central control unit which controls the conveyance of the carrier cases along the main conveyance path as well as transference of the articles between the main conveyance path and the station and the movement of the carrier cases at the station itself. A detector is located in each station to detect if a malfunction occurs in any of the stations and reports any malfunctions to the central control unit. If a malfunction is detected, the central control unit operatively disconnects the malfunctioning station from the rest of the system so that no carrier cases may be sent to the malfunctioning station and no carrier cases may be sent from the malfunctioning station to the rest of the system, while maintaining normal functioning of the rest of the system.

18 Claims, 16 Drawing Sheets

APPARATUS FOR CONVEYING ARTICLES

BACKGROUND OF THE INVENTION

1. Field of the Invention

The present invention relates to an apparatus for conveying articles from one location to one of a plurality of other locations in a large building. In particular, although not necessarily limited thereto, this invention may be used in a hospital to convey charts, slips, medicine, and other miscellaneous articles from a first location or department to a second designated location or department in the hospital.

2. Description of the Related Art

Copending U.S. application Ser. No. 938,644 to Matsuo et al., and assigned to Toshiba K.K. was filed on Dec. 5, 1986, and discloses an apparatus for conveying carrier cases containing articles. The apparatus comprises a main conveyance path and a plurality of branch conveyance paths extending therefrom. Each branch conveyance path includes a pair of vertically displaced conveying belts which extend downwardly to a supply section and a receipt section. One of the vertical conveying belts conveys carrier cases downwardly from the main conveyance path to the receipt section and the other conveying belt conveys carrier cases supplied to the apparatus at the supply section upwardly to the main conveyance path. A lateral conveying belt is provided orthogonally to the lower end portions of the vertical conveying belts within the receipt section and the supply section. When a carrier case arrives at the receipt section via the first vertical conveying belt, the lateral conveyor belt conveys the carrier cases forwardly in the receipt section. When a carrier case is placed in the supply section, the lateral conveying belt is reversed to convey the carrier cases back towards the second vertical conveyor belt onto which it is transferred. The articles are conveyed within the carrier cases at high speed with little noise through the system. Since the articles are contained in carrier cases, they are transferred in a very stable manner.

The apparatus discussed above is subject to a decrease in efficiency of operation of the system as a whole if a malfunction occurs at any one of the branch conveyance paths.

SUMMARY OF THE INVENTION

It is an object of the present invention to provide a conveying apparatus for carrier cases containing articles in which the articles can be rapidly conveyed without loss of efficiency in operation due to a malfunction of one of the branch conveyance paths.

This object, and other objects are accomplished by providing a conveying apparatus including a main conveyance path for conveying articles between a plurality of stations. Each stations include a stop position located on the main conveyance path, a branch conveyance path which is adjacent to the stop position and an input/output section. Each station also has means for transferring conveyed carrier cases from the stop position to a branch conveyance path. The branch conveyance path includes two vertically disposed adjacently located conveyor belts which extend towards the input/output section. The belts include a horizontal portion which is adjacent the stop position. Transfer means are provided to transfer the carrier cases from the main conveyance path to the horizontal position. The input/output section provides user access to the branch conveyance path so that cases may be supplied to or removed from the system.

In a second embodiment, the input/output section may include additional storage location for the cases. In the second embodiment, the input/output section includes means for automatically moving the cases in a U-shaped path from an output position of the input/output section to an input position. The U-shaped path serves as a temporary storage area. The input/output section has means for opening and closing the carrier cases as well as means for sterilizing the interior of the cases.

This apparatus may include one or more of each type of input/output section, each associated with one branch station. The apparatus also includes central control means for controlling the main conveyance path and the operation of the stations. If one or more of the stations becomes mechanically inoperable, the central control means operatively disconnects the station from the system in response to a detector located at each station. Conveyance of carrier cases between the other stations continues normally.

BRIEF DESCRIPTION OF THE DRAWINGS

FIG. 2*a* shows an open carrier case and FIG. 2*b* shows a closed carrier case.

DETAILED DESCRIPTION OF THE PREFERRED EMBODIMENTS

Figure 1A:
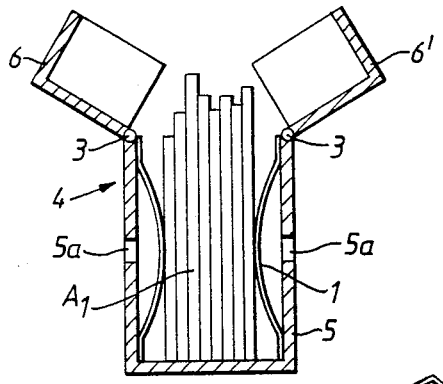
FIGS. 1*a* and 1*b* are cross sectional views of carrier cases for containing articles which are to be conveyed from one location to another.
Figure 1B:
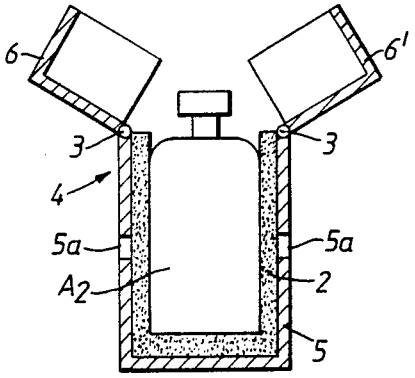

In FIGS. 1a and 1b, carrier cases 4 contain different types of articles A1 or A2 to be conveyed, for example, charts, slips or containers for liquids. Carrier cases 4 are substantially identical externally, however, they are internally adjusted to accommodate the articles which are to be contained and conveyed. For example, carrier case 4 in FIG. 1a is adapted for carrying articles such as charts or slips and includes leaf springs 1 set face to face on its opposite inner surfaces. Leaf springs 1 clips articles A1 therebetween ensuring a secure fit and providing for easy removal and replacement. In FIG. 1b, carrier case 4 is adapted for container A2 for liquids which must be firmly secured. Inner case 2 is inserted between the inner walls of carrier case 4 and container A2 to prevent excess vibration.

Figure 2A:
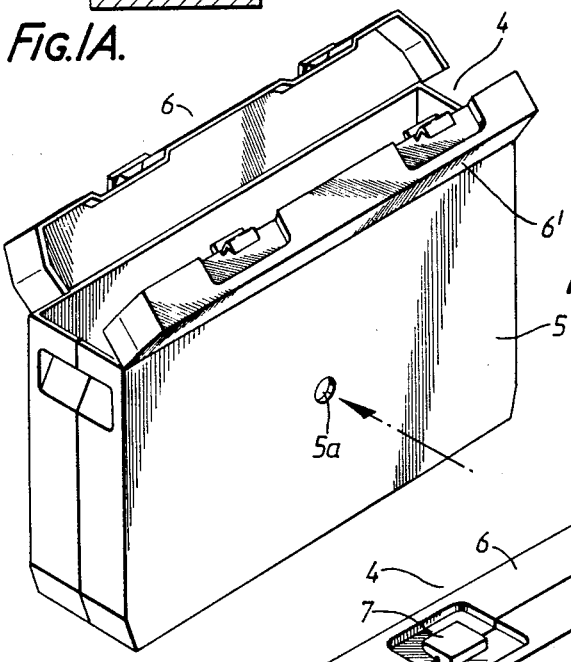
FIGS. 2*a* and 2*b* are perspective views of the carrier cases shown in FIGS. 1*a* and 1*b* where
Figure 2B:
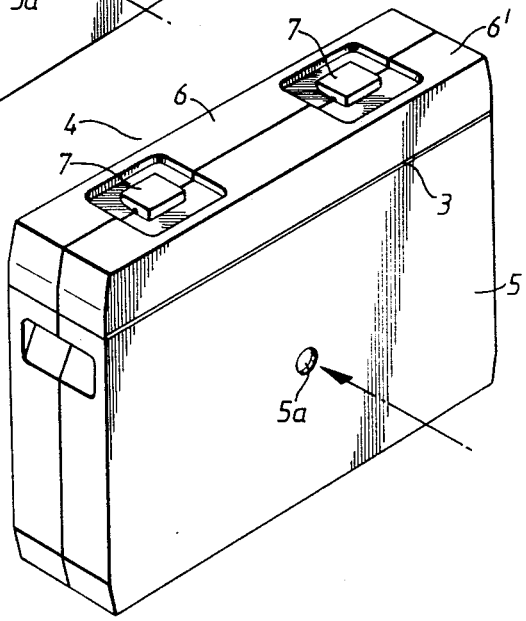

As shown in FIGS. 2a and 2b, carrier case 4 has rectangularly shaped main body 5 with a top opening. A pair of covers of 6 and 6' are latched by latches 7. Main body 5 is made out of aluminum and covers 6 and 6' and latches 7 are made of stainless steel. Covers 6 and 6' are pivotally connected to main body 5 by hinges 3. Hinges 3 are elastic members which urge and maintain covers 6 and 6' in an open position. Conveyed articles A1 or A2 are contained within the main body 5 and covered by covers 6 and 6' which are then locked by latches 7. In order to remove the articles when body 5 is closed, latches 7 are released allowing covers 6 and 6' to open. Hole 5a is formed on the side wall of main body 5 so that a photosensor may detect whether conveyed articles are contained in carrier case 4.

Figure 3:
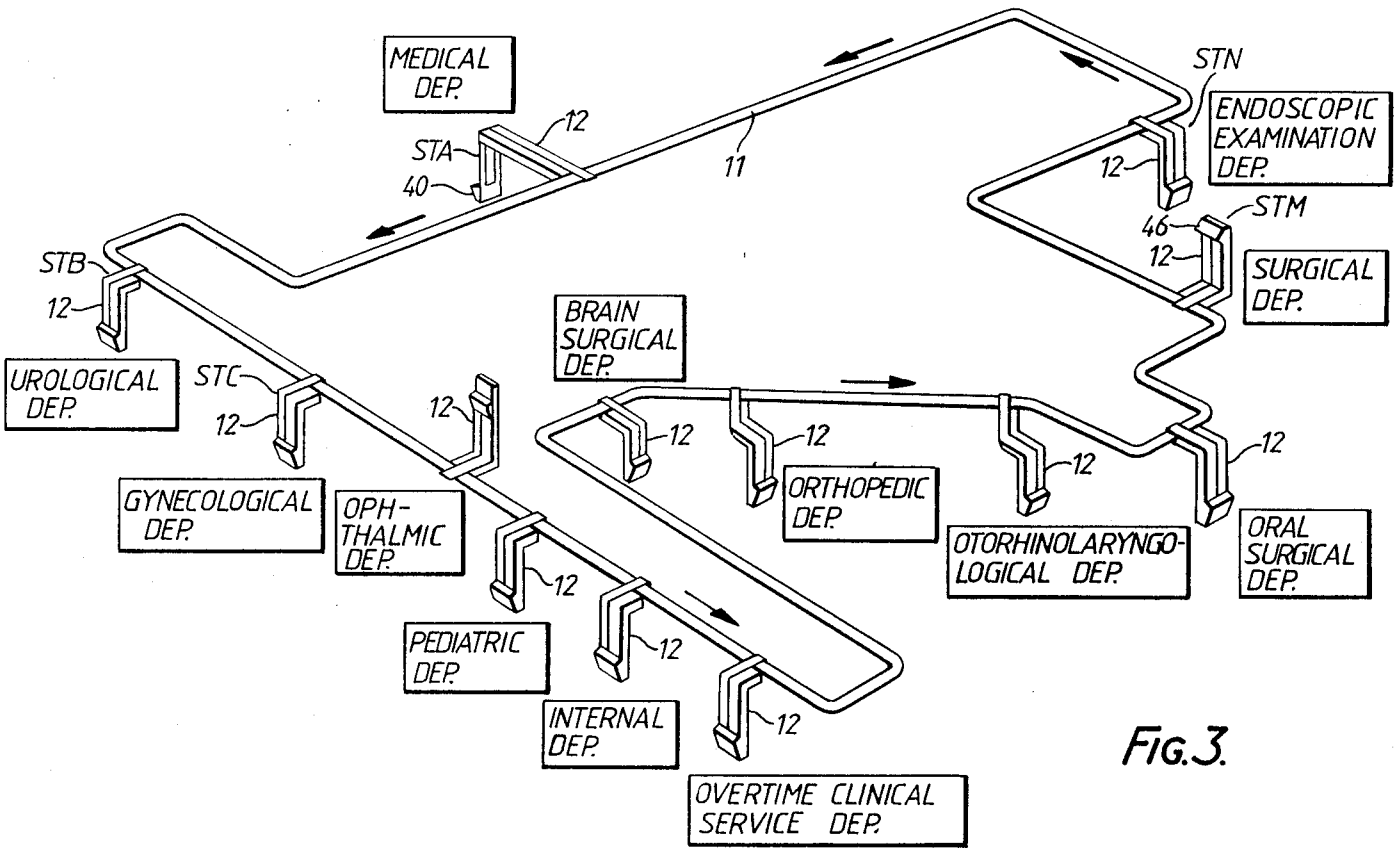
FIG. 3 is a perspective view showing the conveying apparatus according to the present invention.

FIG. 3 schematically shows a conveying apparatus installed in a hospital for conveying articles contained in carrier cases. Main conveyance path 11 conveys carrier cases 4 and is installed in the ceiling or under the floor of the various rooms to be reached by the system. A plurality of branch conveyance paths 12 extend from main conveyance path 11 into each room, for example, the departments shown in FIG. 3. Branch conveyance paths 12 extend from main conveyance path 11 at a plurality of stop positions 22. Each branch conveyance path 12 extends to either first embodiment of input/output section 40 or second embodiment of input/output section 46. Branch conveyance path 12 to stop position 22, input/output section 40 or 46, and transferring device 23 (See FIGS. 6 and 7) together form a station. For example, station STA includes first embodiment of input/output section 40 while station STM includes a second embodiment of input/output section 46.

Each branch conveyance path 12 is located to convey carrier cases 4 to places which are easy to reach in the rooms on each floor of the hospital. The surgical department and the ophthalmological department are located on the second floor of the building and branch conveyance paths 12 for these departments are shown extending upwardly from main conveyance path 11 while the other departments are located on the first floor and their branch conveyance paths 12 are shown extending downwardly.

Figure 4:
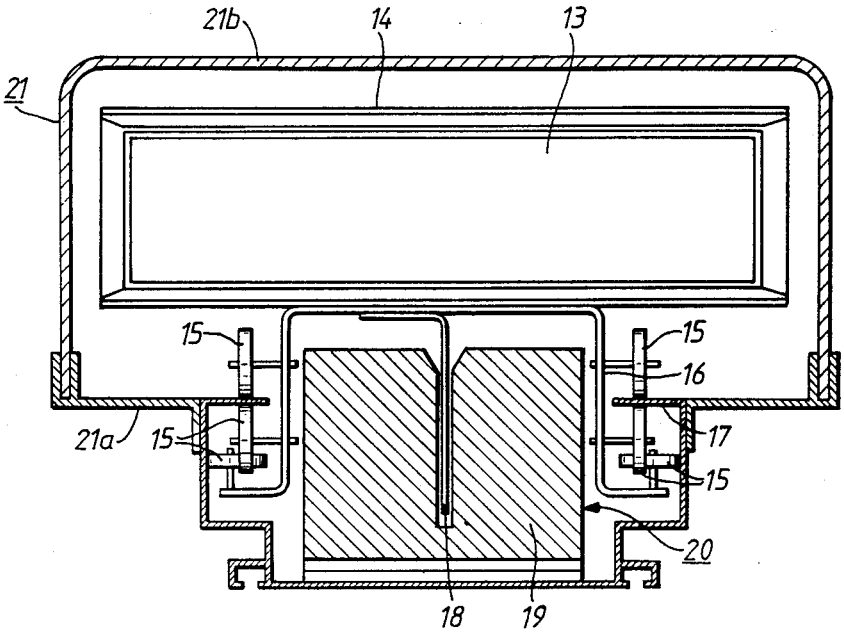
FIG. 4 is a cross-sectional view of the main conveyance path of the conveying apparatus shown in FIG. 3.
Figure 5:
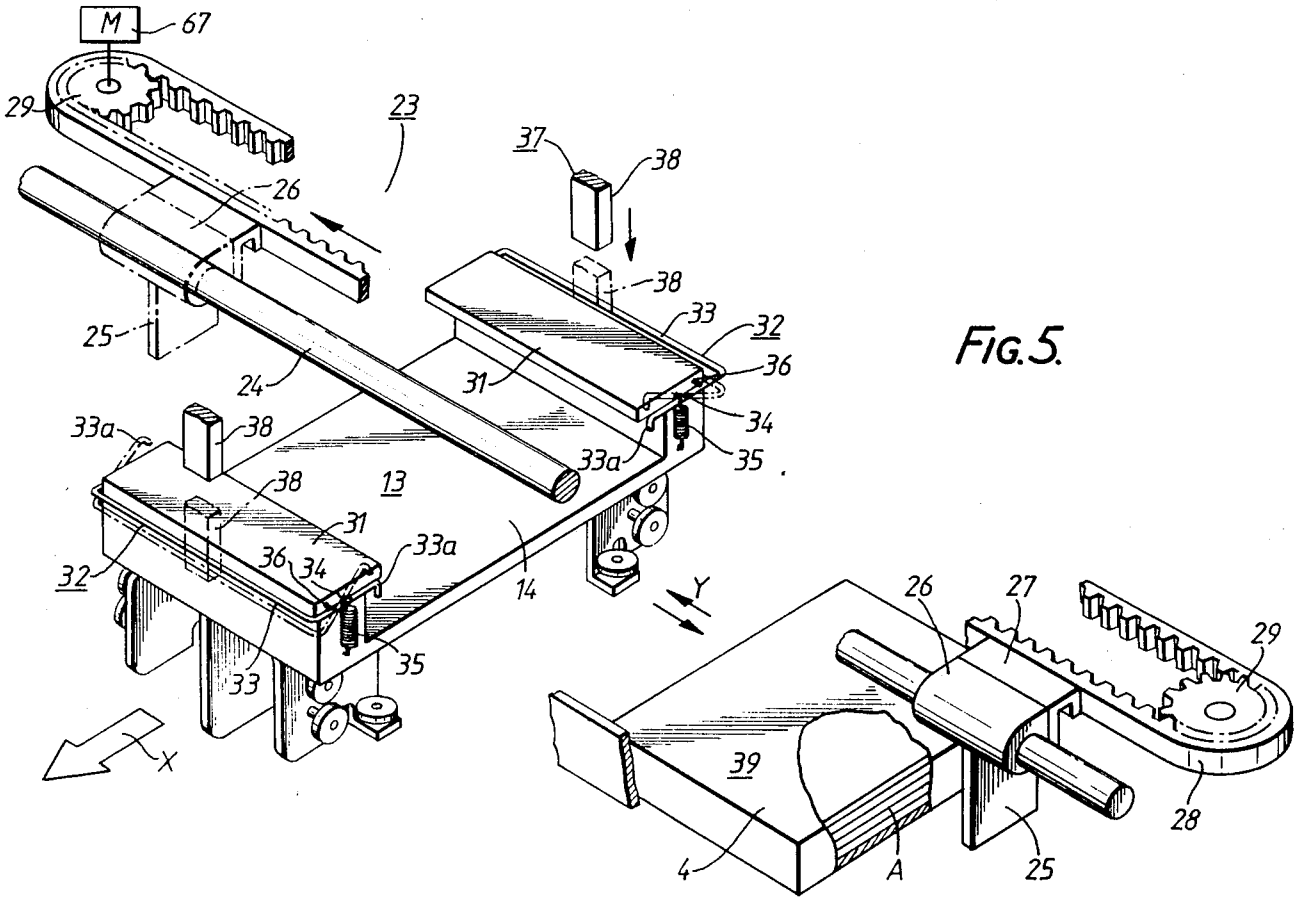
FIG. 5 is a perspective view of a carrier body and a transferring device located at a stop position adjacent a branch conveyance path in the conveying apparatus of FIG. 3.

As shown in FIGS. 4 and 5, main conveyance path 11 conveys carrier body 14 having holding section 13 which holds one carrier case 4. Carrier body 14 is supported by support member 16 within main conveyance path 11. Each support member 16 has a plurality of guide rollers 15 which are located above and below guide rail 17 located near each side of main conveyance path 11. A third guide roller of 15 on each side is perpendicular to the other two and contacts a side wall of main conveyance path 11. Thus carrier body 14 rolls along guide rails 17 at high speed within main conveyance path 11.

Reaction plate 18 extends downwardly from the lower surface of support member 16. Stators 19 are arranged within main conveyance path 11 at specified distances and contain a groove into which reaction plate 18 fits. Reaction plate 18 and stator 19 together form linear motor 20. Reaction plate 18 is a secondary conductor and stators 19 are primary conductors. When electrical current is applied to stator 19 from a power supply (not shown), a magnetic flux is created and applied to reaction plate 18. The intensity of the magnetic flux changes in time, and reaction plate 18 is accelerated or decelerated within main conveyance path 11 according to the change of magnetic flux intensity. The construction and functioning of linear motor 20 which controls the movement of carrier body 14 is shown and discussed in detail in U.S. Pat. No. 4,613,801 to Matsuo et al.

Cases 21 covers main conveyance path 11 and includes lower half 21a and upper half 21b which enclose the space in which carrier body 14 travels. Upper half 21b is located above carrier body 14 and lower half 21a is located below carrier body 14. Inspection and maintenance of main conveyance path 11 is facilitated by the fact that upper half 21b can be detached from lower half 21a.

Figure 7:
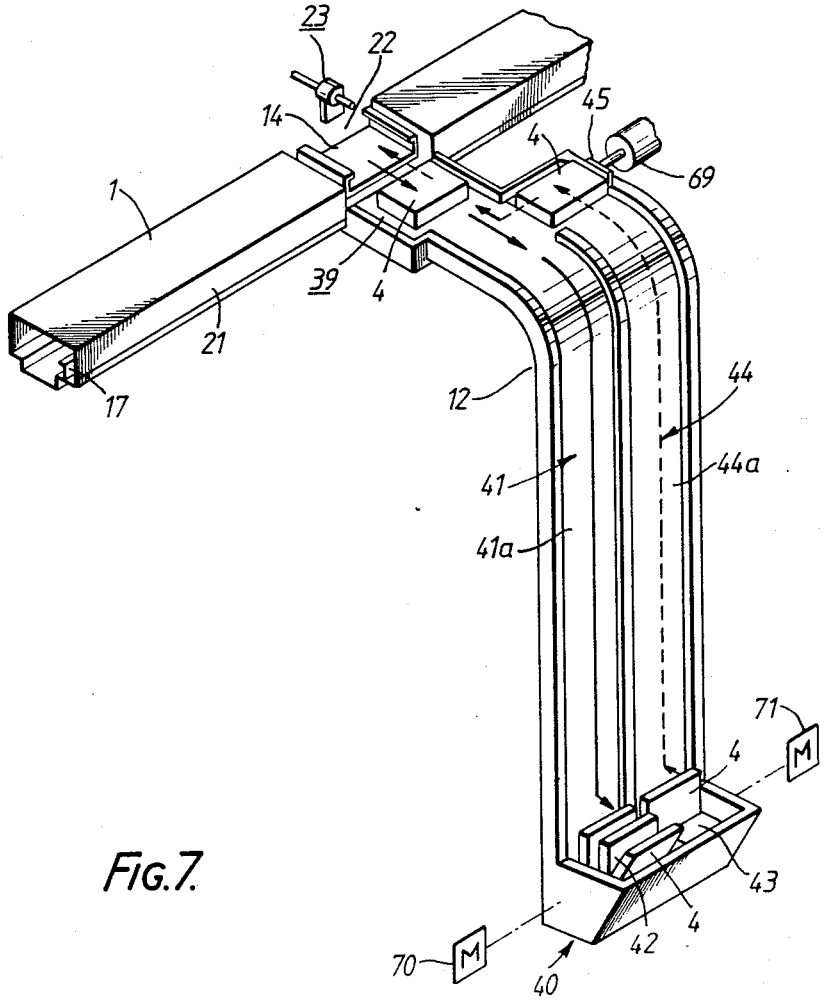
FIG. 7 is a perspective view showing a station including a stop position, branch conveyance path, transferring device, and input/output section according to one embodiment of the invention.

Stators 19 are located at each stop position 22 along main conveyance path 11 where branch conveyance paths 12 are branched off as shown in FIG. 7. Carrier body 14 may be selectively stopped at each stop position 22. At each stop position 22, transferring device 23 is provided for transferring carrier cases 4 from main conveyance path 11 to transferring position 39 of branch conveyance path 12. under the control of a control circuit shown in FIG. 13. Transferring of carrier cases 4 containing articles or which are empty is done automatically.

Figure 6:
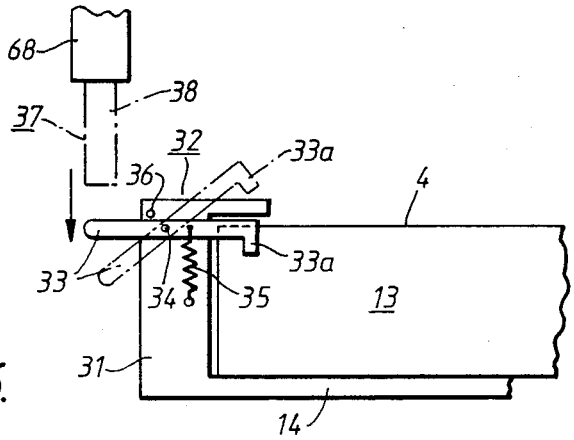
FIG. 6 is a front view of a carrier case release mechanism shown in the transferring device of FIG. 5.

Transferring device 23 is shown in FIGS. 5 and 6. Guide shaft 24 is provided perpendicularly to main conveyance path 11 and is located above the path of travel of carrier body 14 which moves in the X direction. Movable member 26 is attached to pushing plate 25 and is slidably mounted on guide shaft 24. Movable member 26 is also connected with timing belt 28 through connecting member 27. Timing belt 28 is located around a pair of pullies placed near both ends of guide shaft 24 on either side of main conveyance path 11. One of pullies 29 is operatively connected with first pulse motor 67. The rotation of pulse motor 67 causes movable member 26 having push plate 25 to move reciprocatively in the Y direction.

Push plate 25 extends below guide shaft 24 which allows it to contact and push one side of carrier case 4. The forward movement of push plate 25 causes carrier case 4 which is held within holding section 13 of carrier body 14 to be pushed from holding section 13 to transferring position 39 of branch conveyance path 12. Reverse movement of push plate 25 pushes carrier case 4 from transferring position 39 into holding section 13 of carrier body 14.

Carrier body 14 has a pair of holding frames 31 extending therefrom and having an L-shaped cross section. Holding frame 31 cooperates to hold carrier cases 4 in holding section 13 of carrier body 14. Carrier cases 4 held within holding section 13 are immobile in both the X direction and in the vertical direction but are freely movable in the transferring or Y direction.

Fixing mechanism 32 prevents carrier 4 from being dislodged from holding section 13 and carrier body 14 while being conveyed. Fixing mechanism 32 is provided on carrier body 14 and includes a pair of fixing member 33 connected to holding frame 31. Fixing members 33 are made of wire rods bent in a C-shaped configuration with downwardly bent ends 33*a*. Fixing members 33 rotate around a pair of pins 34 which protrude from their opposite side. Springs 35 move fixing members 33 into a position abutting stop 36 protruding from one vertical side of holding frame 31. This position is represented by the solid lines in FIGS. 5 and 6 with bent ends 33*a* located within holding section 13 of carrier body 14. In this position, bent ends 33*a* abut on opposite vertical side surfaces of carrier cases 4 which are securely held within holding section 13.

Each stop position 22 is further provided with a pair of release mechanisms 37 located on either side of carrier body 14 when it is centered in stop position 22 to release carrier cases 4 from fixing mechanism 32. Release mechanism 37 includes pushing rods 38. Pushing rods 38 are moved downwardly by first cylinder 68 and thereby abut and push down the middle portion of fixing member 33. As a result, fixing members 33 are rotated into the position shown by the dot/dash line in FIGS. 5 and 6. Bent ends 33*a* are lifted out of holding section 13 of carrier body 14 and carrier cases 4 are no longer held within holding section 13 and can be moved in the Y direction.

As shown in FIG. 7, branch conveyance path 12 is located adjacent stop position 22 and receives carrier case 4 conveyed from main conveyance path 11. Branch conveyance path 12 includes transfer position 39, first carrier path 41, second carrier path 44 and first embodiment of input/output section 40. Carrier path 41 includes vertically disposed carrier belt 412 and second carrier path 44 includes vertically disposed carrier belt 44*a*. Each belt includes a substantially horizontally disposed portion. First input/output section 40 includes carrier case output section 42 and carrier case input section 43 adjacent thereto. First carrier belt 41 conveys carrier cases 4 from transfer position 39 downwardly to output section 42 of first input/output section 40. Second carrier belt 44*a* conveys carrier cases 4 from input section 43 upwardly towards transfer position 39 which is located in the ceiling or under the floor of a room.

Pusher 45 is provided at the end of second carrier path 44 located opposite of input section 43, that is, near transfer position 39. Pusher 45 is driven by second cylinder 69 connected thereto. When operated, pusher 45 pushes carrier case 4 from its position at the end of carrier path 44 to the adjacent end of first carrier path 41 in front of transfer position 39. Carrier case 4 is conveyed from its position on first carrier path 41 to transfer position 39 by first carrier belt 41*a* which is driven in the opposite direction by second pulse motor 70. Second carrying belt 44*a* provided in second carrier path 44 is driven by third pulse motor 71.

Figure 8:
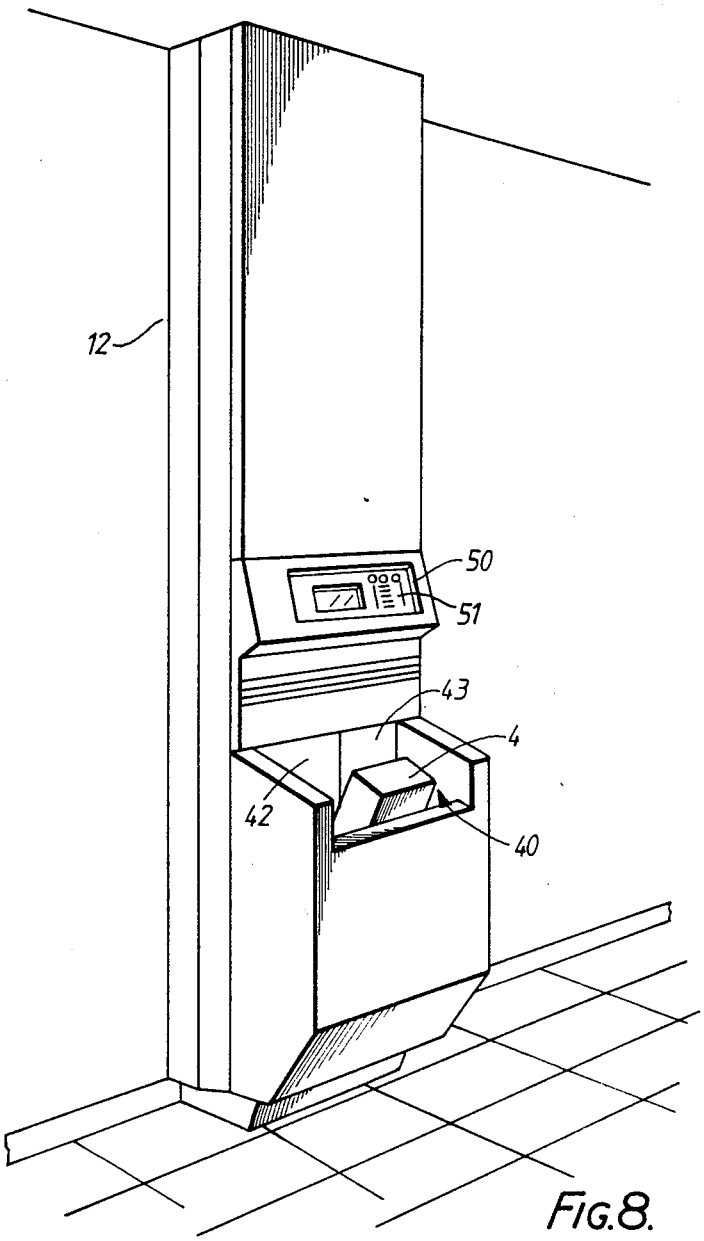
FIG. 8 is an external view of a station including a first embodiment of input/output section.

FIG. 8 shows a perspective view of branch conveyance path 12 including first embodiment of input/output section 40 installed on the floor of, for example, the medical department located on the first floor of the building. Input/output section 40 faces into the room and includes input section 42 which receives carrier cases 4 which have been carried from main conveyance path 11 by first carrier path 41 of branch conveyance path 12. Alternatively, carrier cases 4 may have been placed within output section 43 of input/output section 40 by an operator. Carrier case 4 is carried to main conveyance path 11 via second carrier path 44.

Control section 50 includes control panel 51 provided above input/output section 40. A plurality of keys, an indicating lamp and a chime (not shown) are mounted on the surface of control panel 51. When carrier cases 4 arrive at input/output section 40, the indicating lamp and the chime of control panel 51 are lighted and sounded to notify the operator of its arrival. A detector (not shown) for detecting whether covers 6 and 6' of carrier cases 4 are opened or shut is provided within first input/output section 40. If carrier case 4 is placed within input section 43 and a destination is specified by making use of the plurality of keys on the control panel 51, the detector will detect whether cover 6 or 6' are shut. When a detector detects that covers 6 and 6' are shut, carrier case 4 is carried by second carrying belt 44*a* upwardly to the position adjacent pusher 45.

Figure 9A:
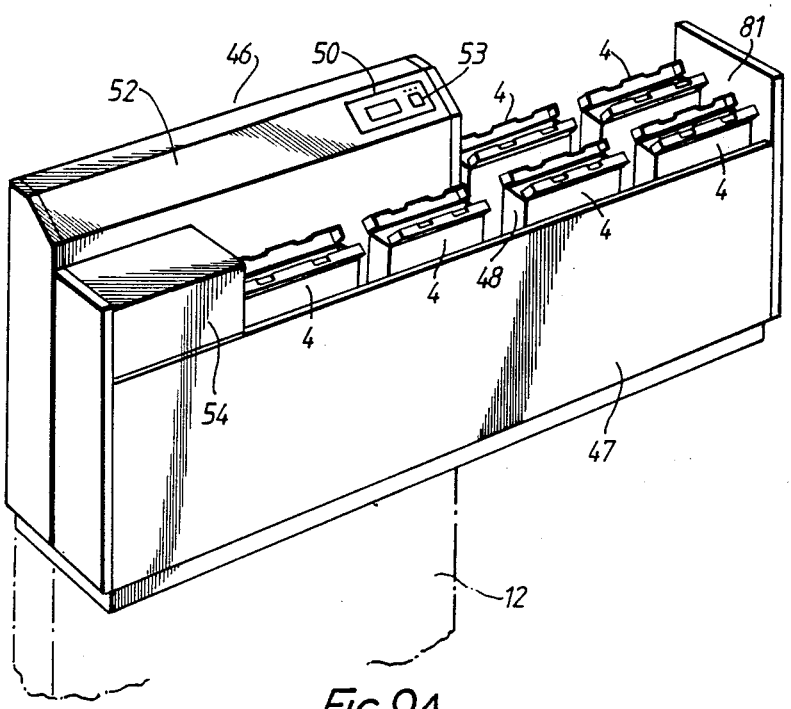
FIG. 9*a* is a perspective view of an input/output section according to a second embodiment of the invention.
Figure 9B:
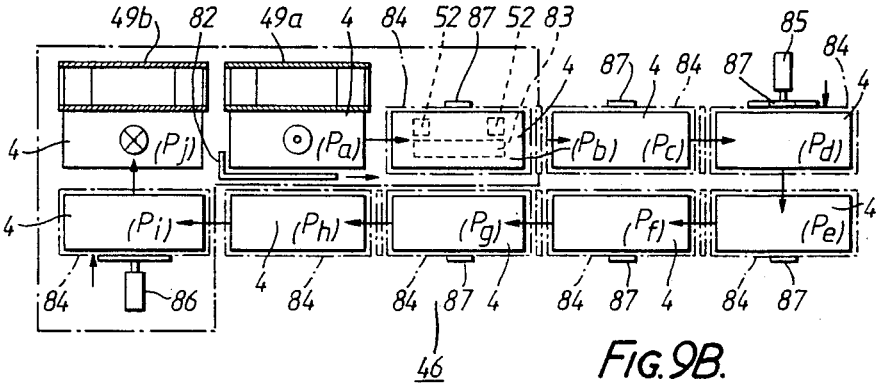
FIG. 9*b* is a schematic top view of the second input/output section shown in FIG. 9*a*.

FIGS. 9*a* and 9*b* show a second embodiment of input/output section 46 installed on the floor of, for example, the surgical department which is located on the second floor. Housing 47 is provided with opening 48 at its upper end thereof. Two separate and adjacent belts are provided beneath positions (Pa) and (Pj). Vertical belts 49*a* is disposed beneath (Pa) and carries carrier cases 4 delivered from main conveyance path 11 to second input/output section 46. Adjacent belt 49*a* is vertical belt 49*b* located beneath position (Pj). Vertical belt 49*b* carries carrier cases 4 downward from input/output section 46 towards main conveyance path 11. Vertical belts 49*a* and 49*b* constitute branch conveyance path 12.

Pusher 82 is located at position (Pa) and transfers carrier cases 4 carried by vertical belt 49*a* to position (Pb) which is located adjacent and to the right of position (Pa). At position (Pb), opening device 52 shown in FIG. 10 and described below is provided for opening cover 6 and 6' of carrier cases 4. An ultraviolet sterilization device 83 is also provided at position (Pb) for sterilizing the inside of carrier cases 4 if they arrive empty at input/output section 46. When carrier cases 4 arrive with conveyed articles, then sterilization device 83 does not operate.

Transfer belts 84 are provided at position (Pb) through (Pi) to transfer carrier cases 4 successively as shown by the arrows in FIG. 9*b*. Belts 84 constitute a U-shaped conveyance path on which carrier cases 4 are arranged within housing 47. Position (Pc) through (Ph) constitute temporary storage section 81 and in any of these positions, an operator may remove articles from carrier cases 4 or place articles within carrier cases 4. Transfer belts 84 horizontally convey carrier cases 4 along temporary storage sections 81.

Pusher 85 is provided at position (Pd) to transfer carrier cases 4 to position (Pe) in a position perpendicular to the movement of transfer belts 84. Pusher 86 is provided at position (Pi) to transfer carrier cases 4 to position (Pj). Photosensors 87 are provided in the walls of housing 47 at positions (Pb) through (Pg) and detect whether conveyed articles are contained within carrier cases 4 by irradiating light through hole 5*a* on one side thereof. As shown in FIG. 9*1*, positions (Pa), (Pb), (Pj) and (Pi) are covered by cover members. Closing device 54 is provided at position (Pi) to close covers 6 and 6' of carrier cases 4 which have been transferred from position (Ph).

Figure 10:
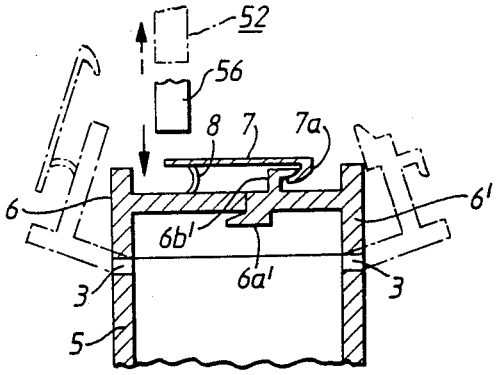
FIG. 10 is an explanatory view showing the operation of an opening device provided in the input/output section shown in FIG. 9*a*.

As shown in FIG. 10, carrier cases 4 include covers 6 and 6' and latch 7. Leaf spring 8 is provided between one end of latch 7 and the upper surface of cover 6 and functions as a swingable hinge. The other end of latch 7 has forked portions 7*a* which engages with claw 6*b'* formed on an upper surface of cover 6'. Projection 6*a'* is formed at the edge and beneath cover 6' and functions to support the edge of cover 6 when cover 6 and 6' are engaged to close main body 5. Opening device 52 includes pushing member 56 and a moving member (not shown) which moves pushing member 56 in the vertical direction.

When cover 6 and 6' are engaged to close carrier cases 4, the hinge portion of latch 7 is positioned beneath pushing member 56. To open case 4 pushing member 56 is moved downwardly and pushes the hinge portion of latch 7, as shown by the solid line in FIG. 10. As a result, forked portion 7*a* is disengaged from claw 6*b'*. Hinges 3 are provided on cover 6 and 6' and rotate them into the position shown by the dash lines in FIG. 10 and thus to automatically open carrier cases 4 when forked portion 7*a* is disengaged from claw 6*b'*.

Figure 11A:
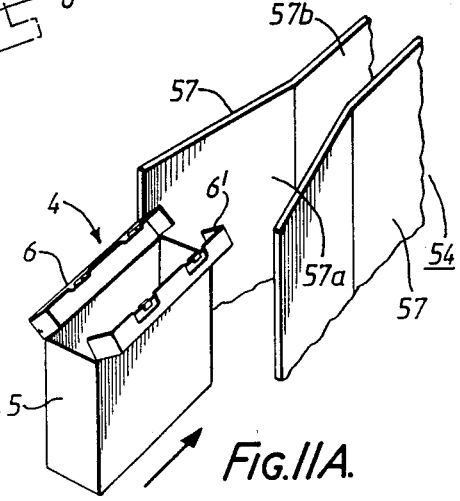
FIGS. 11*a*–11*c* are explanatory views showing the operation of a closing device provided in the input/output section shown in FIG. 9*a* and 9*b*.
Figure 11B:
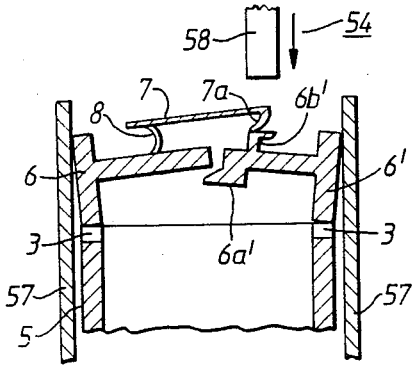
Figure 11C:
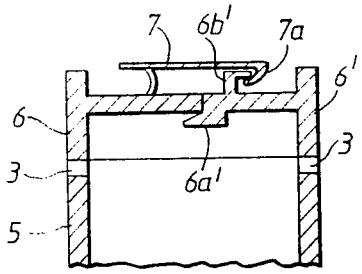

Cover 6 and 6' of carrier case 4 are closed by the operation of closing device 54 provided in input/output section 46 as shown in FIGS. 11*a* to 11*c*. Closing device 54 includes a pair of side walls 57, pusher 58 and a moving member (not shown) for moving pusher 58 in the vertical direction. Side walls 57 are opposite each other and form a space through which carrier cases 4 are moved. One end of each side wall 57 is inclined outwardly to form a wide space portion 57*a* therebetween. Space portion 57*b* is formed between two parallel sections of side wall 57 and is narrower than portion 57*a*. Open carrier cases 4 pass through wide space portion 57*a* and move within the space provided between side walls 57 until they reach narrow portion 57*b* which forces covers 6 and 6' to close. In this closed position, the edge of cover 6 touches edge portion 6*a'* of cover 6'. Forked portion 7*a* contacts the tip of claw 6*b* as shown in FIG. 11*b*. Pusher 58 is positioned above forked portion 7*a* and is moved downward to push fork portion 7*a* which fully engages below claw 6*b'* and thus locks covers 6 and 6' in the closed position. Projection 6*a'* supports the edge of cover 6 as shown in FIG. 11*c*.

With further reference to FIGS. 9*a* and 9*b*, the operation of second input/output section 46 will be described. Carrier cases 4 containing conveyed articles are carried by vertical belt 49*a* to position (Pa). Pusher 82 pushes carrier cases 4 towards position (Pb), and at position (Pb) carrier case 4 is located on transfer belt 84. At position (Pb), opening device 52 acts to open covers 6 and 6' of carrier cases 4. Ultraviolet sterilization device 83 does not operate if photosensor 87 detects that conveyed articles are located within carrier cases 4. If photosensor 87 detects that conveyed articles are not located within carrier cases 4, ultraviolet sterilization device 83 operates to sterilize the inside of carrier cases 4. Thereafter, carrier case 4 is transferred to position (Pc) by the movement of transfer belt 84. When carrier case 4 is moved to position (Pc), the chim mounted on control panel 53 sounds to indicate that carrier case 4 contains articles which must be removed.

After conveyed articles are removed from carrier cases 4, photosensor 87 at position (Pc) detects that carrier case 4 is vacant and as a result the chime stops. If a successive carrier case arrives at position (Pb), vacant carrier case 4 located at (Pc) is then transferred towards position (Pd) by the movement of transfer belt 84. Vacant carrier cases 4 will remain at position (Pc) until a successive carrier case 4 arrives at position (Pb). Therefore, carrier cases 4 are advanced whenever successive carrier cases 4 arrive at position (Pb) by means of vertical belt 49*a* which delivers carrier cases to position (Pa). Carrier cases 4 are transferred from position (Pd) to position (Pe) by pusher 85 and are conveyed by belt 84.

Position (Ph) is an input position where carrier cases 4 containing articles to be conveyed are placed. Carrier cases 4 containing an article to be conveyed are either placed within input/output section 46 at position (Ph), or a vacant case already located at position (Ph) is filled with an article. The operator specifies the destination on control panel 53 and pushes the "START" button, and carrier cases 4 is moved towards closing device 54 at position ($P_1$). At position ($P_i$), cover 6 and 6' of carrier cases 4 are automatically closed by closing device 54. Then carrier case 4 is transferred towards ($P_j$) by the action of pusher 86. At position ($P_j$), carrier case 4 is carried downward towards main conveyance path 11 by vertical belt 49*b*. Positions (Pc) through (Pg) may be used as a temporary storage location for carrier cases 4 which are kept open.

Figure 12:
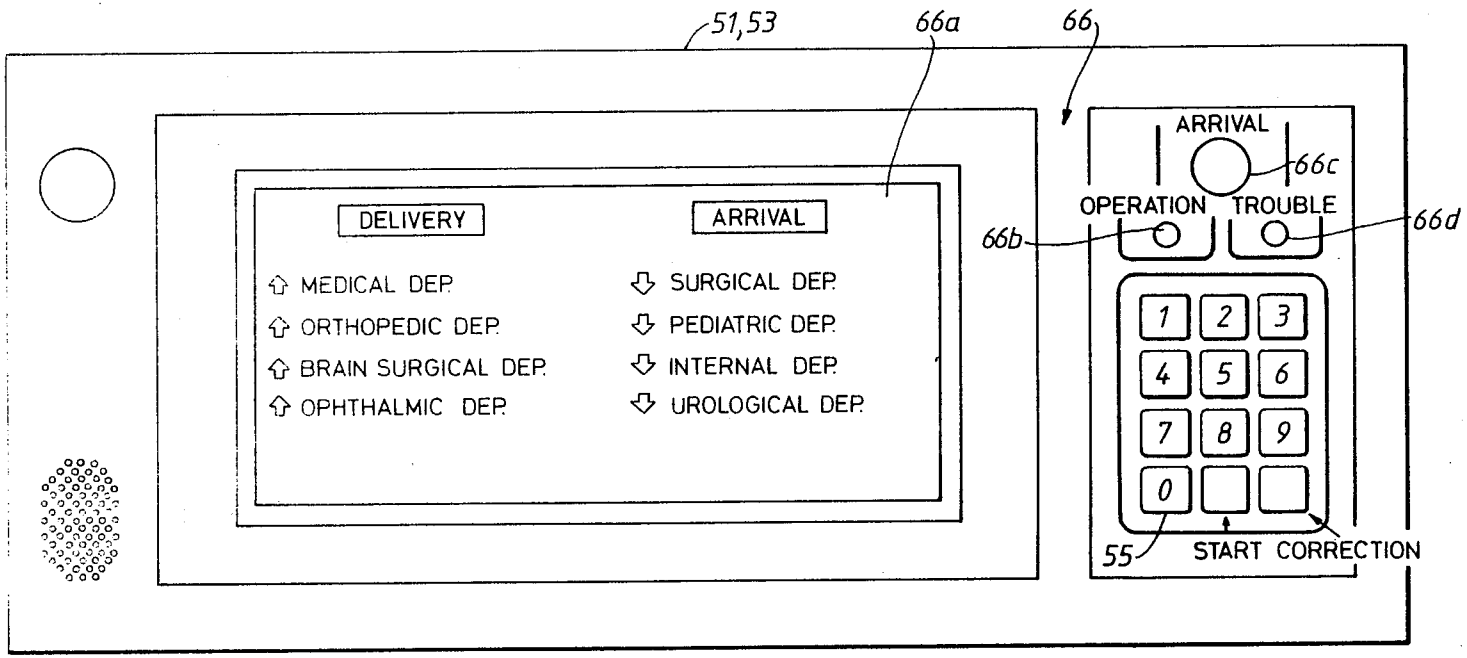
FIG. 12 is front view of the control panel located at each station.

FIG. 12 shows an embodiment of control panel 51 or 53 installed at first and second input/output sections 40 or 46 in conjunction with a branch conveyance path of a station. Indicator 66 and digital keyboard 55 are provided on the control panels. Indicator 66 includes display board 66*a* and indicating lamp 66*b*, 66*c* and 66*d*. Indicating lamp 66*b* is lit to indicate "OPERATION" when the branch conveyance path associated with this control panel is in operation. Indicating lamp 66*c* is lit to indicate "ARRIVAL" when carrier cases 4 arrive at the branch conveyance path associated with this control panel. Indicating lamp 66*d* is lit to indicate "TROUBLE" when the branch conveyance path associated with this control panel is malfunctioning. The names of stations from which cases arrive or to which they are delivered are indicated at the time of arrival or delivery on display board 66*a*. Display board 66*a* includes arrow marks and corresponding names of delivery stations are decided on the basis of the number of carrier cases 4 temporarily accumulated in first input/output sections 40 or second input/output section 46. When arrow marks and addresses are not indicated, vacant carrier cases 4 move around in first input/output section 40 or second input/output section 46.

Digital keyboard 55 is used to input the address of the desired location to which the carrier cases are to be sent. After the number corresponding to the address is input on the digital keyboard 55 arrow marks and addresses will be indicated. When the START button is pushed, the carrier cases is conveyed. It is also possible to change the desired address of the location by pushing the CORRECTION button down and inputting a corrected code number for an address which is indicated on control panel 51 or 53.

Figure 13A:
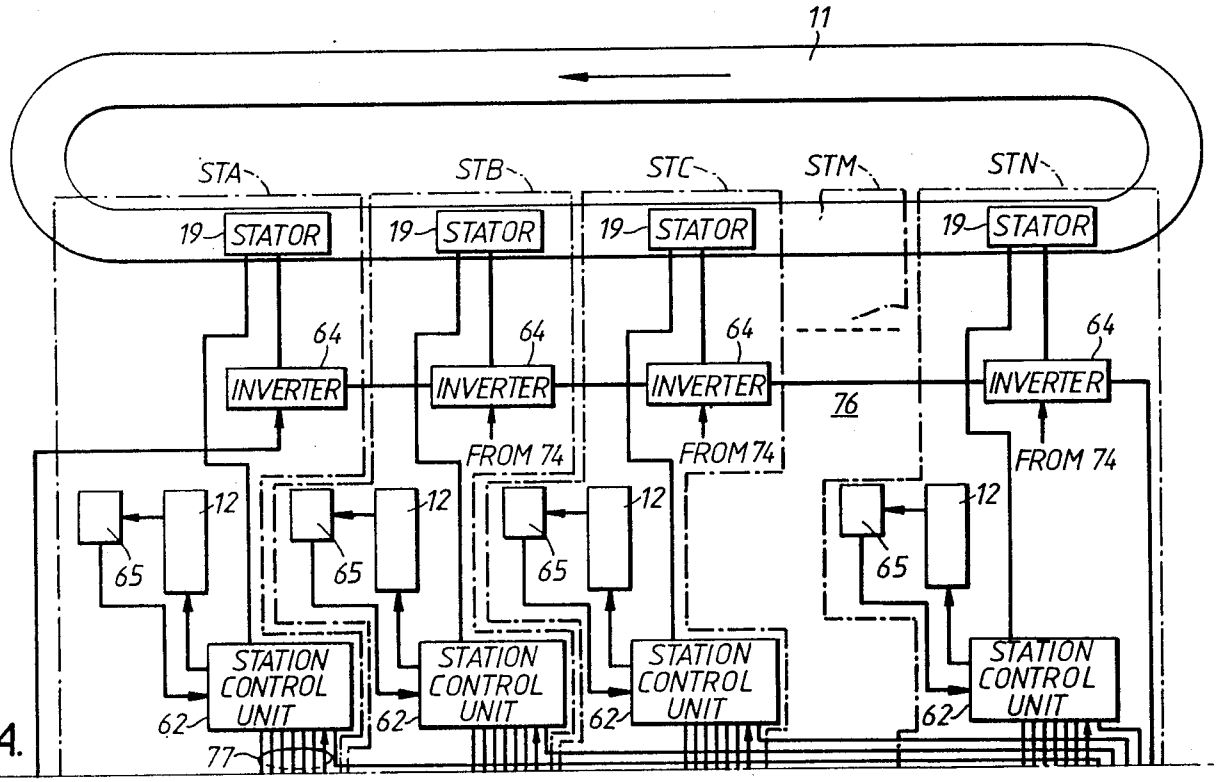
FIGS. 13A and 13B are jointly a block diagram showing a control circuit for controlling the apparatus.
Figure 13B:
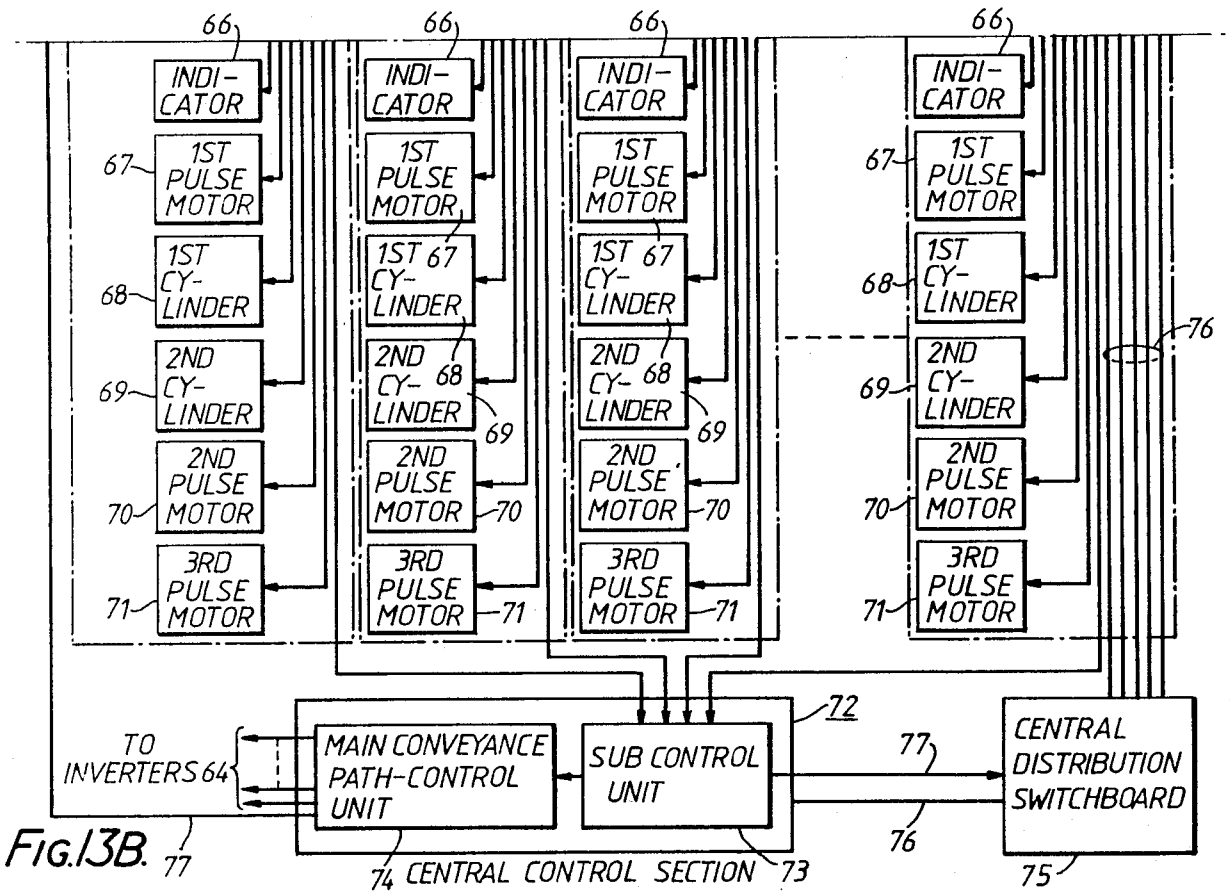

FIGS. 13A and 13B are jointly a block diagram showing a control circuit for the the conveying apparatus according to the present invention. The control circuit includes a plurality of station control units 62 which provide control for the movement of carrier body 14 at stators 19 and for the transfer of carrier cases 4 at each branch conveyance path 12. The control circuit includes central control section 72 which controls each station control unit 62. Central control section 72 controls the entire conveying apparatus and includes subcontrol unit 73 connected with each station control unit 62 and main conveyance path control unit 74. Station control units 62 are provided for each station STA, STB, STC,—STM, and STN which are installed in each department as shown in FIG. 3. Each stator 19 receives frequency controlled power from inverter 64. Inverter 64 are controlled by main conveyance path control unit 74 to adjust the frequency controlled power. Carrier bodied 14 are moved along main conveyance path 11 in the direction of the arrow according to the frequency control power supplied from inverter 64 to stator 19.

Station control unit 62 controls the transfer of carrier cases 4 from carrier body 14 to transfer position 39 of branch conveyance path 12 when carrier bodies 14 are at stop positions 22 associated with each stator 19. Station control units 62 control the conveyance of carrier cases 4 on branch conveyance path 12 or cause them to be temporarily stored in first embodiment of input/output section 40. Each station control unit 62 is connected to first pulse motor 67, first cylinder 68, second cylinder 69, second pulse motor 70 and third pulse motor 71. Each first pulse motor 67 and first cylinder 68 controls the operation of transferring device 23 as described above. Each second cylinder 69 operates pusher 45, each second pulse motor 70 controls the movement of first carrier belt 41*a* and each third pulse motor 71 controls the motion of second carrier belt 44*a* as described above. Detectors 65 are provided on each branch conveyance path 12 to detect any malfunction therein. Detectors 65 transmits an abnormal signal to station control unit 62 if a malfunction occurs. Indicators 66 are connected with each station control unit 62, respectively. Indicator 66 is provided on control panel 51 or 53 and includes display board 66*a* and indicating lamp 66*b*, 66*c* and 66*d* as discussed above.

Central distribution switchboard 75 links each station control unit 62, as well as its associated stators 19 via inverter 64 to central control section 72 to supply electric power via power source lines 76 shown by the thick lines in FIG. 13. In FIG. 13, thin lines represent electric signal lines 77 for transmission thereof.

Central control section 72 includes both subcontrol unit 73 and main conveyance path control unit 74 linked thereto. Main conveyance path control unit 74 controls the conveyance of carrier bodies 14 on main conveyance path 11, and also controls the stopping of carrier bodies 14 for transference of carrier cases 4 to branch conveyance path 12. If a malfunction occurs subcontrol unit 73 receives an abnormal signal from detector 65 indicating a malfunction of branch conveyance path 12 via station control unit 62. As a result, subcontrol unit 73 issues a command preventing carrier bodies 14 from stopping at a branch conveyance path where trouble has occurred so that carrier cases may not be transferred. Subcontrol unit 73 also commands main conveyance path control unit 74 to return carrier body 14 back to the station from which it was sent if the condition of carrier body 14 permits.

Detectors 65 detect trouble at branch conveyance paths 12. That is, if first carrying belt 41*a* or second carrying belt 44*a* is immobile due to a disorder of second pulse motor 70 or third pulse motor 71, detector 65 detects the trouble and transmits an abnormal signal to station control unit 62. Station control unit 62 transfers the abnormal signal to subcontrol unit 73 of central control section 72. Subcontrol unit 73 separates the station in which the malfunction occurs, for example, station STA from the controlling system. A signal is transmitted from subcontrol unit 73 to each station control unit 62 for each of the other stations and to main conveyance path control unit 74 that station STA has been operatively disconnected from the system. Central control section 72 continues to control the other stations. Station STA in which the malfunction occurs may later be recovered. Until recovery, stator 19 in station STA will act only as a means to provide a forward or reverse propelling force to carrier body 14 without acting as a stopping means. Additionally, station control unit 62 of branch conveyance path 12 for another station, for example, STN from which it is desired to send carrier cases, will not accept a request to convey carrier cases to branch conveyance path 12 associated with station STA. Station control unit 62 in station STN actuates indicator 66 to indicate that station STA is out of order. Since station STA corresponds to the medical department the indication "MEDICAL DEP. OUT OF ORDER" will be displayed on display board 66*a* to warn the operator that it is not possible to convey carrier cases thereto. When a station malfunctions, the method for controlling the conveying system varies according to the location of carrier case 4 as follows.

When carrier case 4 is being conveyed:

Carrier case 4 will be sent back to the station from which it came. Main conveyance path control unit 74 of central control section 72 actuates stator 19 via inverter 64 so that carrier case 4 in carrying body 14 is temporarily stopped at stator 19 associated with the branch conveyance path in the malfunctioning station. Then, main conveyance path control unit 74 reactuates the same stator to move carrier body 14 holding carrier case 4. When carrier body 14 is conveyed near the station STN from which it originated, it is stopped at stator 19 associated with that station by control of other stators 19 in order of their appearance on the route to station STN. When carrier body 14 is stopped at stator 19 located at station STN, station control unit 62 associated with station STN controls transferring device 23 to transfer carrier case 4 from carrier body 14 onto transferring position 39, as shown in FIG. 7. Then, station control unit 62 actuates second pulse motor 70 to move first carrier belt 41*a* of first carrier path 41. As a result, carrier case 4 is carried from transferring position 39 to output section 42 in input/output section 40. When carrier case 4 arrives at output section 42, station control unit 62 in station STN actuates indicator 66 to indicate "MEDICAL DEP. SENT BACK" on display board 66*a* to warn the operator that the conveyance of carrier cases 4 to the medical department is impossible.

When carrier case 4 is still located in branch conveyance path 12 of originating station STN:

Subcontrol unit 73 of central control section 72 receives an abnormal signal from station control unit 62 of branch conveyance path 12 of station STA to which a carrier body is to be sent indicating that station STA is malfunctioning. Subcontrol unit 73 transmits the abnormal signal to each station control unit 62 associated with all the other stations. Station control unit 62 of station STN, that is, the origin station for the carrier cases controls second and third pulse motor 70 and 71 respectively and second cylinder 69 to move first and second carrier belts 41*a* and 44*a* as well pusher 45. Carrier case 4, which is temporarily located on second carrier belt 44*a* before being transferred to carrier body 14 is sent back to output section 42 by actuation of pusher 45 transferring it to first carrier belt 41*a* where upon it is carried downward. When carrier case 4 arrives at output section 42, station control unit 62 associated with station STN actuates indicator 66 to indicate "MEDICAL DEP.  SENT BACK" which is lighted on display board 66*a* to warn the operator that the conveyance of carrier cases 4 to the medical department, that is, station STA is impossible. Carrier case 4 remains in output section 42 until malfunctioning station STA is recovered by the system.

When the operator of STN which is the origin of a carrier case instructs the system to convey carrier case 4 to STA immediately after carrier case 4 is placed in input section 43 of input/output section 40 associated with branch conveyance path 12 of origin station STN:

Carrier case 4 remains in input section 43 and is not conveyed to station STA. Station control unit 62 associated with station STN actuates indicator 66 to indicate "MEDICAL DEP.  OUT OF ORDER" on display board 66*a* to warn the operator that conveyance of carrier cases 4 to the medical department is not possible. Carrier case 4 remains in input section 43 until malfunctioning station STA is recovered by the system.

It is clear that although in the foregoing embodiment only one of the plurality of branch conveyance paths is malfunctioning, a plurality of branch conveyance paths may simultaneously malfunction. All of the malfunctioning branch conveyance paths which are controlled by the central control section are isolated from the system while the normally functioning branch conveyance path continues to operate.

Figure 14A:
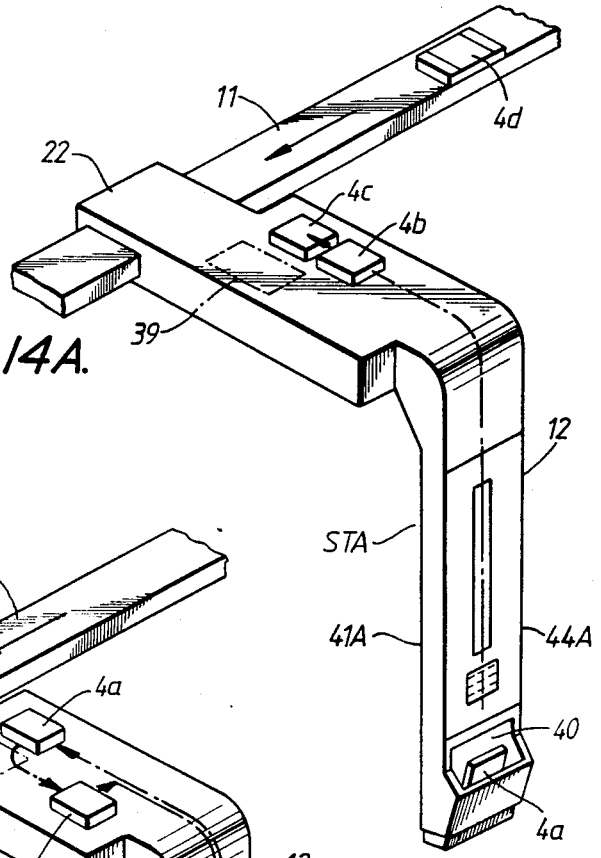
FIGS. 14*a*–14*c* are explanatory views showing the flow of carrier cases between the main conveyance path and an input/output section according to the first embodiment.
Figure 14B:
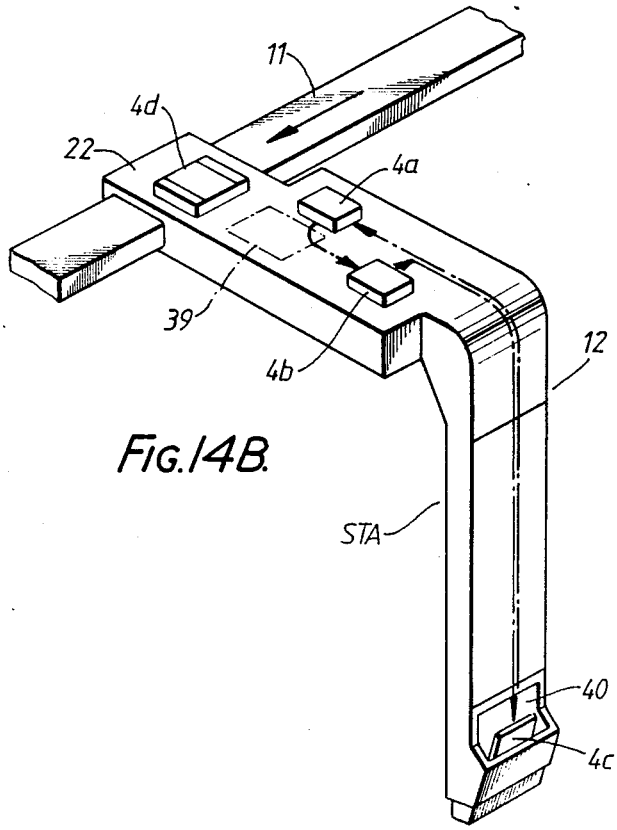
Figure 14C:
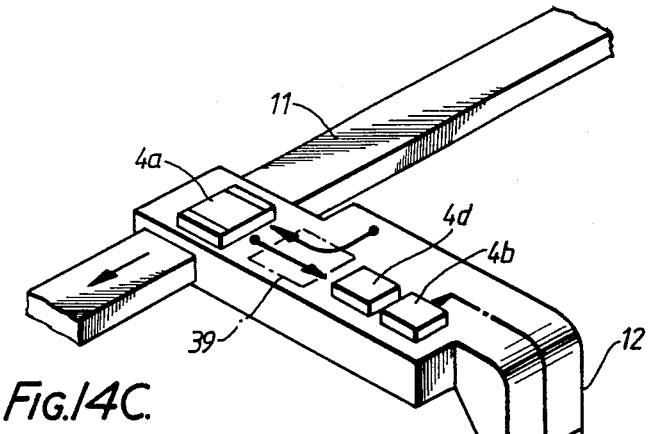
Figure 15A:
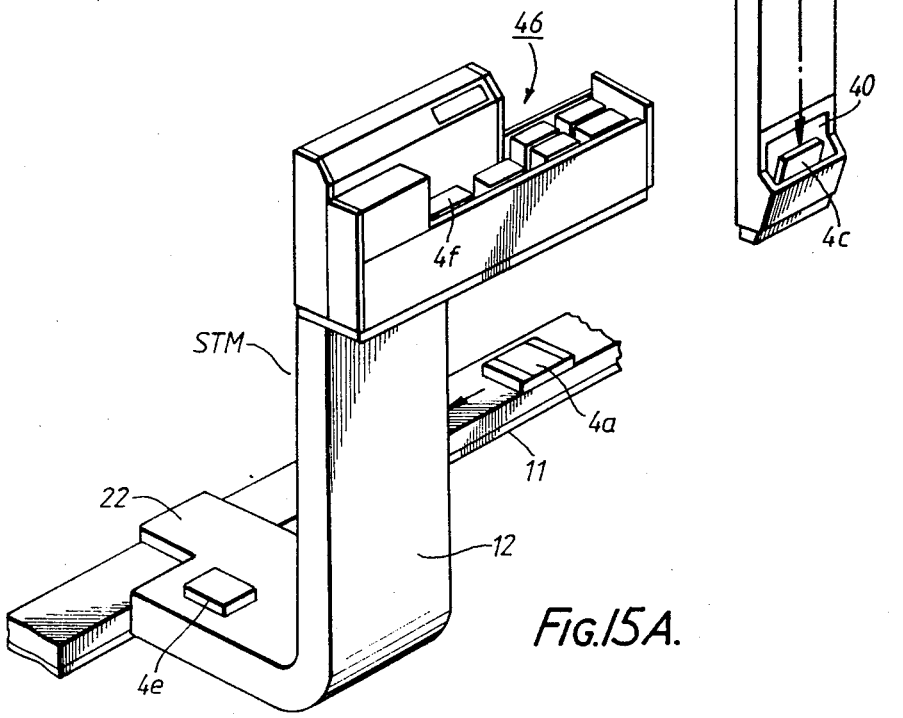
FIGS. 15a–15c are explanatory views showing the flow of carrier cases between the main conveyance path and an input/output section according to the second embodiment.
Figure 15B:
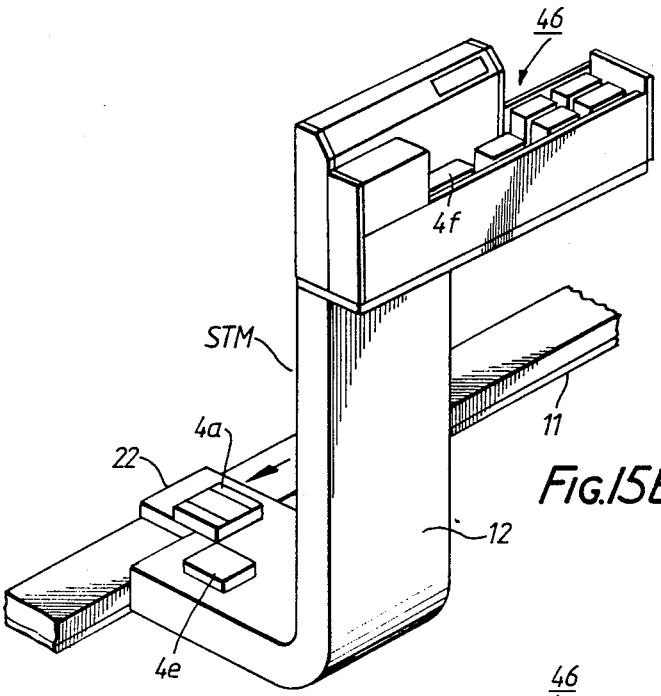
Figure 15C:
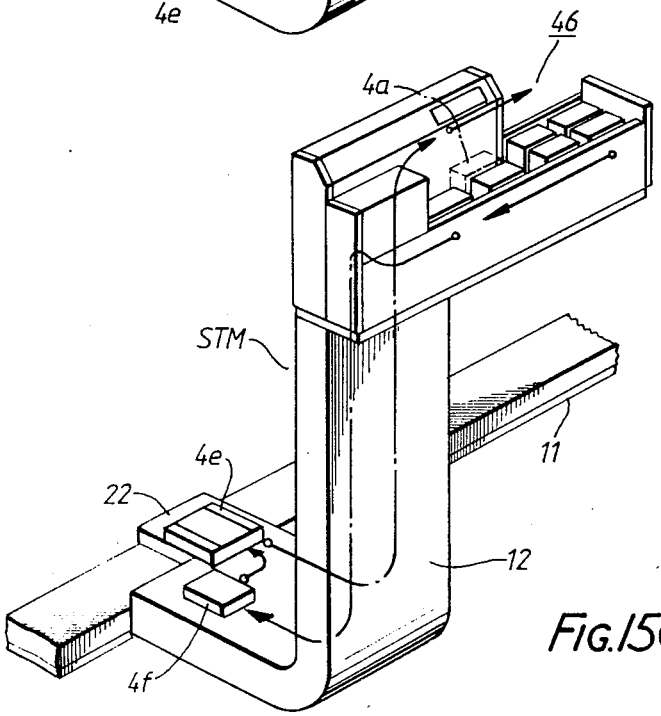

The normal operations of the apparatus when all of the stations are functioning normally will be described with reference to FIGS. 14*a* to 15*c*. FIGS. 14*a* to 14*c* show the conveyance of cases at branch conveyance path 12 of station STA located at, for example, the medical department on the first floor as shown in FIG. 3. FIGS. 15*a* to 15*c* show the conveyance of carrier cases carried from station STA to, for example, branch conveyance path 12 associated with station STM installed in the surgical department on the second floor as shown in FIG. 3.

FIG. 14 shows first carrier case 4*a* containing articles to be conveyed from station STA to station STM, and second and third empty carrier cases 4*b* and 4*c* which have been previously conveyed to the end portion of second carrier path 44. After second and third carrier cases 4*b* and 4*c* are successively moved onto first carrier path 41 by actuation of pusher 45, first carrier case 4*a* can be place in first embodiment of input/output section 40.

As shown in FIG. 14*b*, when fourth carrier case 4*d* containing articles to be conveyed is stopped at stop position 22 on main conveyance path 11, third carrier case 4*c* is moved to first input/output section 40 via first carrier path 41 while second carrier case 4*b* remains at the end of first carrier path 41 as shown in FIG. 14*d*. Then, fourth carrier case 4*d* is transferred to transferring positions 39 by transferring device 23 as shown in FIG. 14*c*.

Then, first carrier case 4*a* containing articles to be conveyed which has been placed in first input/output section 40 is moved to transferring position 39 via second carrier belt 44*a* of second carrier path 44 after an address has been specified on control panel of Station STA. Transferring device 23 tranfers first carrier case 4*a* onto carrier body 14 which is stopped at stop position 22. Then first carrier case 4*a* is then conveyed to designated station, for example, station, STM, along main conveyance path 11.

As shown in FIGS. 15*a*–15*b*, first carrier case 4*a* is conveyed to stopped position 22 adjacent station STM and is then carried to second embodiment of input/output Section 46. A fifth carrier case 4*e* is transferred to carrier body 14 in place of first carrier case 4*a* as shown in FIG. 15*c* as well. At all times each carrier body 14 holds one carrier case 4, and at each stop position 22 a carrier case held within carrier body 14 is exchanged with a second carrier case. Therefore, the number of carrier cases located on main conveyance path 11 constant.

Figure 16A:
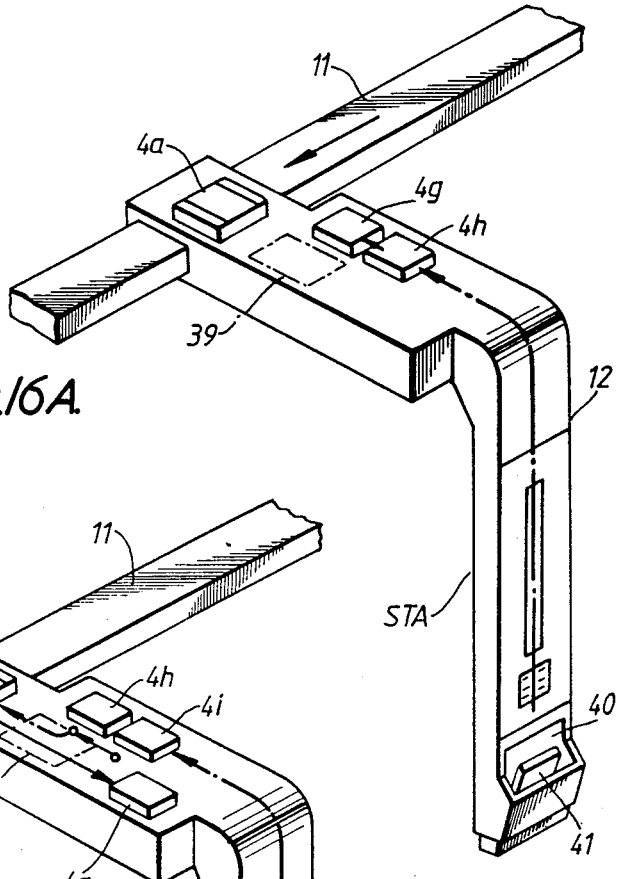
FIGS. 16a–16c are explanatory views showing the flow of carrier cases between the main conveyance path and in the input/output section according to the first embodiment when a carrier cases arrive at a stop position from another station.
Figure 16B:
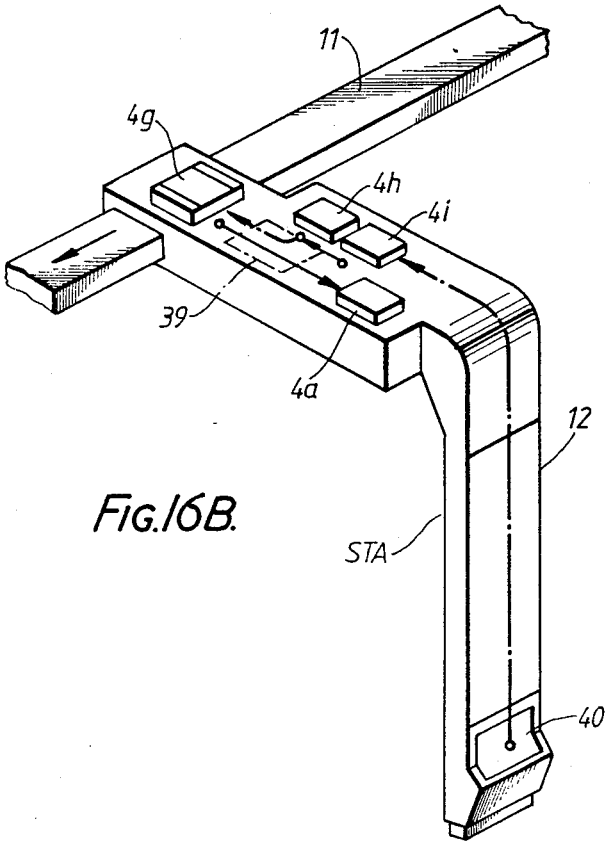
Figure 16C:
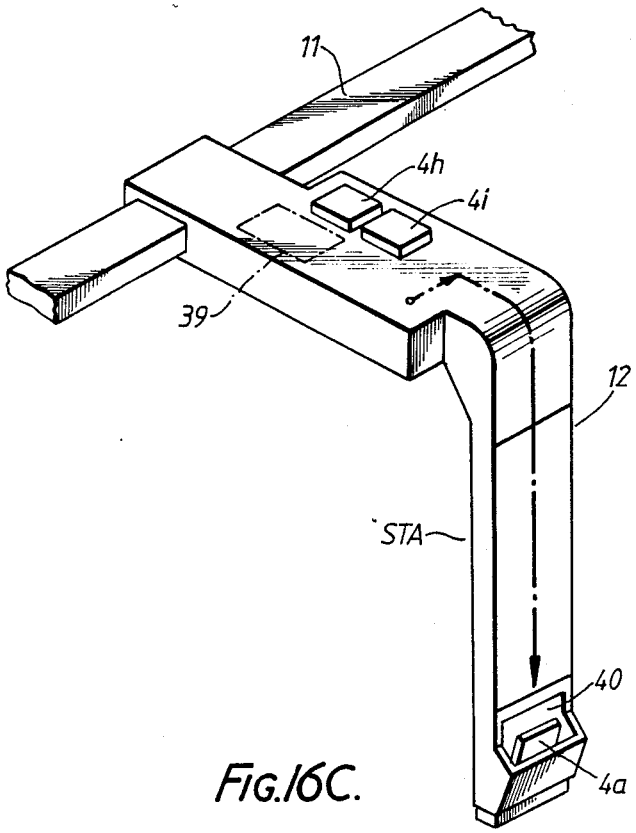

FIGS. 16*a* to 16*c* shows the flow of carrier cases 4 when conveyed carrier case 4*a* reaches station STA. When first carrier case 4*a* held in carrier body 14 reaches stop position 22, its arrival is indicated on control panel 51 of station STA. Then, first carrier case 4*a* is transferred to transfer position 39. Additional carrier cases 4*g*, 4*h* and 4*i* are conveyed upward by the movement of second carrier belt 44*a* of second carrier path 44. Carrier case 4*g* is held in holding section 13 of carrier body 14 and is conveyed to a station addressed on control panel 51. Then, first carrier case 4*a* is carried to first input/output section 40 by operation of first carrier belt 41*a*.

What is claimed is:

1. An apparatus for conveying articles between a plurality of stations, said apparatus comprising:

main conveyance means including a main conveyance path for conveying said articles between an origin station and a destination station, any of said plurality of stations capable of serving as either an origin station or a destination station, the destination station of said articles input into said apparatus at said origin station;

each of said plurality of stations including a branch conveyance path extending from said main conveyance path, said branch conveyance paths conveying articles from or to said main conveyance path;

detecting means for detecting a malfunction in said branch conveyance paths and for generating a signal indicating a malfunction; and central control means for controlling said main conveyance means to convey articles between said stations and for independently controlling each said station, said central control means controlling said main conveyance path to operatively disconnect any of said stations from said apparatus in response to a signal transmitted by said detecting means.

2. The apparatus recited in claim 1 further comprising carrier case for containing said articles while being conveyed.

3. The apparatus recited in claim 1 further comprising an input/output section located adjacent each said branch conveyance path.

4. The apparatus recited in claim 3 wherein each said branch conveyance path includes a first carrier means for conveying articles from said main conveyance means to said input/output section, and a second carrier means for conveying articles from said input/output section to said main conveyance means.

5. The apparatus recited in claim 1 wherein, said central control means comprises a central control section including a subcontrol unit and a main conveyance path control unit, said subcontrol unit linked to a detector associated with each station, said detector transmitting a signal to said subcontrol unit indicating any malfunction of its associated station, said subcontrol unit controlling said main conveyance path control unit to control said main conveyance path to prevent articles from being transferred to or from said malfunctioning station.

6. The apparatus recited in claim 5 wherein said main conveyance path includes a plurality of stators, each said stator associated with one said station, said main conveyance path control unit controlling a plurality of inverters, each said inverter controlling one said stator for propelling said article along said main conveyance path or for causing said article to stop adjacent a station.

7. The apparatus recited in claim 5 wherein said subcontrol unit controls a plurality of station control units, each said station control unit associated with one station, said station control unit controlling the functioning of said station to transfer articles between said main conveyance path and said branch conveyance paths.

8. An apparatus for conveying articles between a plurality of stations, said apparatus comprising:

main conveyance means including a main conveyance path for conveying said articles between an origin station and a destination station, any of said plurality of stations capable of serving as either an origin station or a destination station, the destination station of said articles input into said apparatus at said origin station;

branch conveyance means including a plurality of branch conveyance paths extending from said main conveyance path for receiving articles from or delivering articles to said main conveyance path;

transfer means provided on said main conveyance path operatively connecting said main conveyance path with said branch conveyance means;

detecting means for detecting the occurrence of a malfunction in any of said branch conveyance paths and for generating a signal denoting said malfunction; and central control means for controlling said main conveyance path and said transfer means to operatively disconnect any malfunctioning branch conveyance path from said main conveyance path in response to a signal transmitted by said detecting means.

9. The apparatus recited in claim 8 wherein said control means is a central control means for controlling said main conveyance path, said central control means controlling said main conveyance path to return an article conveyed from one branch conveyance path to a malfunctioning branch conveyance path in response to a signal from said detecting means.

10. The apparatus recited in claim 8 wherein each said branch conveyance path extends towards an input/output section, said control means controlling a branch conveyance path which is the origin of an article to be sent to a malfunctioning station to return said article from said branch conveyance path to its associated input/output section in response to a signal from a detector at a malfunctioning branch conveyance path.

11. An apparatus for conveying articles between stations comprising:

main conveyance means including a main conveyance path for conveying said articles between an origin station and a destination station, any of said stations capable of serving as either an origin station or a destination station;

branch conveyance means including a plurality of branch conveyance paths extending from said main conveyance path for receiving articles from or delivering articles to said main conveyance path, each of said stations including one said branch conveyance path;

detecting means for detecting a malfunction in said branch conveyance paths and for generating a signal indicating a malfunction; and central control means for controlling said main conveyance means to convey said articles from said branch conveyance path of said origin station to said branch conveyance path of said destination station, said central control means controlling said main conveyance means to return said articles from said main conveyance means to said branch conveyance path of said origin station in response to a signal indicating a malfunction from said detecting means at said branch conveyance path of said destination station.

12. The apparatus recited in claim 11, said stations including an indicating means controlled by said central control means to indicate a malfunction occurring at said branch conveyance path of said destination station.

13. The apparatus recited in claim 11 wherein said central control means includes station control units to control each said station, said central control means controlling each of said station control units.

14. The apparatus recited in claim 13 wherein each said station further includes an input/output section adjacent said branch conveyance path, said articles being inputted or outputted from said apparatus at said input/output sections.

15. The apparatus recited in claim 14 wherein each said branch conveyance path includes a first carrier path for conveying articles from said main conveyance path to said input/output section, and a second carrier path for conveying articles from said input/output section to said main conveyance path.

16. The apparatus recited in claim 15 wherein said first carrier path comprises a first carrier belt and said second carrier path comprises an adjacent second carrier belt.

17. The apparatus recited in claim 16 wherein said central control means control said first and said second carrier belts.

18. The apparatus recited in claim 17 wherein each said detecting means is connected to an associated station control unit, said station control unit transferring said detecting signals to said central control means.

* * * * *